United States Patent [19]

Zenger

[11] Patent Number: 4,459,793

[45] Date of Patent: Jul. 17, 1984

[54] COMPOSITE CONTAINER CONSTRUCTION

[75] Inventor: Richard D. Zenger, Downers Grove, Ill.

[73] Assignee: National Can Corporation, Chicago, Ill.

[21] Appl. No.: 385,242

[22] Filed: Jun. 4, 1982

Related U.S. Application Data

[63] Continuation of Ser. No. 144,545, Apr. 28, 1980, abandoned.

[51] Int. Cl.[3] ..... B65B 3/00; B65B 7/28; B65B 31/04

[52] U.S. Cl. ..... 53/434; 53/432; 53/449; 53/469; 220/404; 220/426; 220/461; 426/398; 426/404; 426/411

[58] Field of Search ..... 141/3; 426/116, 118, 426/124, 131, 398, 419, 418, 404, 411; 53/403, 408, 400, 432, 407, 449, 440, 405, 434, 469; 220/460, 461, 403, 404, 426, 428, 410, 468, 469

[56] References Cited

U.S. PATENT DOCUMENTS

| | | | |
|---|---|---|---|
| 1,584,903 | 5/1926 | Supplee | 426/398 X |
| 2,326,649 | 8/1943 | Howard | 426/126 |
| 2,364,012 | 11/1944 | Walton et al. | 220/462 X |
| 2,369,765 | 2/1945 | Waters | 426/412 X |
| 2,431,675 | 12/1947 | Bour | 53/400 |
| 2,524,162 | 10/1950 | Chavannes et al. | 426/124 X |
| 2,591,578 | 4/1952 | McNealy et al. | 220/410 X |
| 2,817,124 | 12/1957 | Dybuis | 220/426 X |
| 3,061,165 | 10/1962 | Rench et al. | 220/462 X |
| 3,069,043 | 12/1962 | Bishop | 220/428 |
| 3,118,560 | 1/1964 | Cornelius | 220/469 |
| 3,153,886 | 10/1964 | Christensson | 53/434 |
| 3,169,670 | 2/1965 | Hrelenak et al. | 141/3 |
| 3,255,020 | 6/1966 | Ferrell | 426/398 X |
| 3,261,140 | 7/1966 | Long et al. | 53/434 X |
| 3,443,735 | 5/1969 | Meijers | 220/404 X |
| 3,450,254 | 6/1969 | Miles | 220/404 X |
| 3,610,455 | 10/1971 | Greenhalgh et al. | 220/404 X |
| 3,670,916 | 6/1972 | Alpert | 220/410 |
| 3,785,544 | 1/1974 | Smith | 229/43 X |
| 4,098,404 | 7/1978 | Market | 220/68 |
| 4,348,421 | 9/1982 | Sakakibara et al. | 220/410 |

FOREIGN PATENT DOCUMENTS

| | | | |
|---|---|---|---|
| 2289123 | 5/1976 | France | 426/116 |
| 350598 | 1/1961 | Switzerland | 220/460 |

OTHER PUBLICATIONS

"Nature Fresh in Latex", *Modern Packaging,* pp. 44, 45, Aug. 1941.

*Primary Examiner*—Allan N. Shoap
*Attorney, Agent, or Firm*—Robert A. Stenzel; Ralph R. Rath

[57] ABSTRACT

A container for vacuum packaging of products includes an outer container and an inner liner which conforms generally to the configuration of the outer container and is secured to the upper open end thereof while the remainder of the container and liner are unattached. A vent is provided between the atmosphere and the space between the container and liner so that the liner can expand and collapse as differential pressures are applied to the product sealed in the liner by a plastic film secured open end thereof.

9 Claims, 8 Drawing Figures

ABSORBANT MATERIAL

Fig. 6.
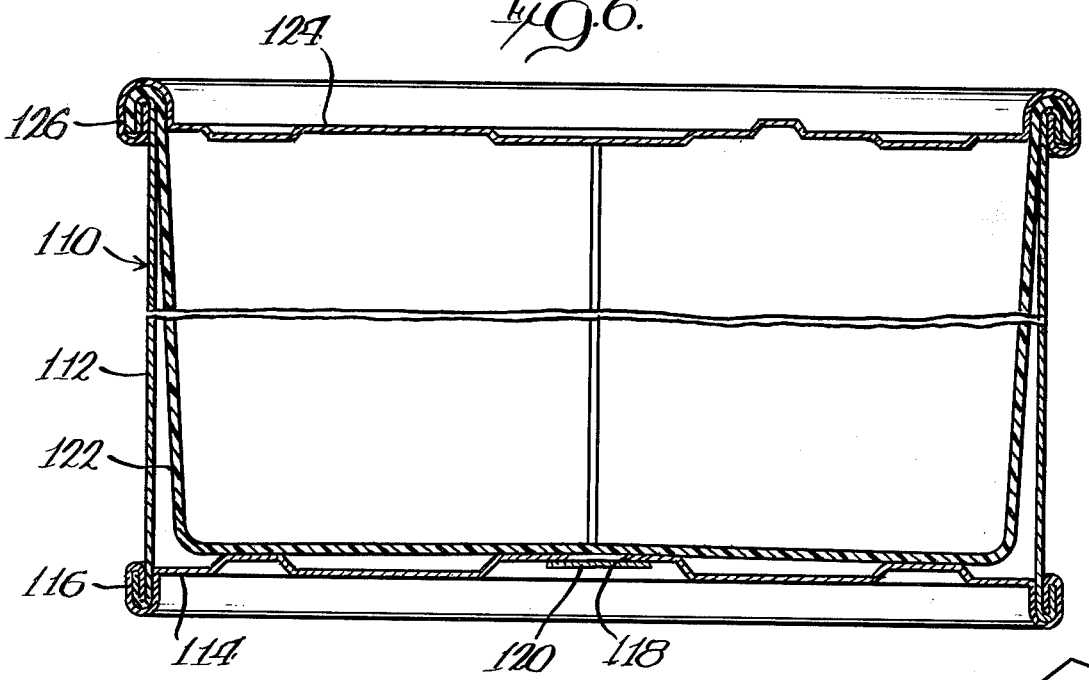
Fig. 7.
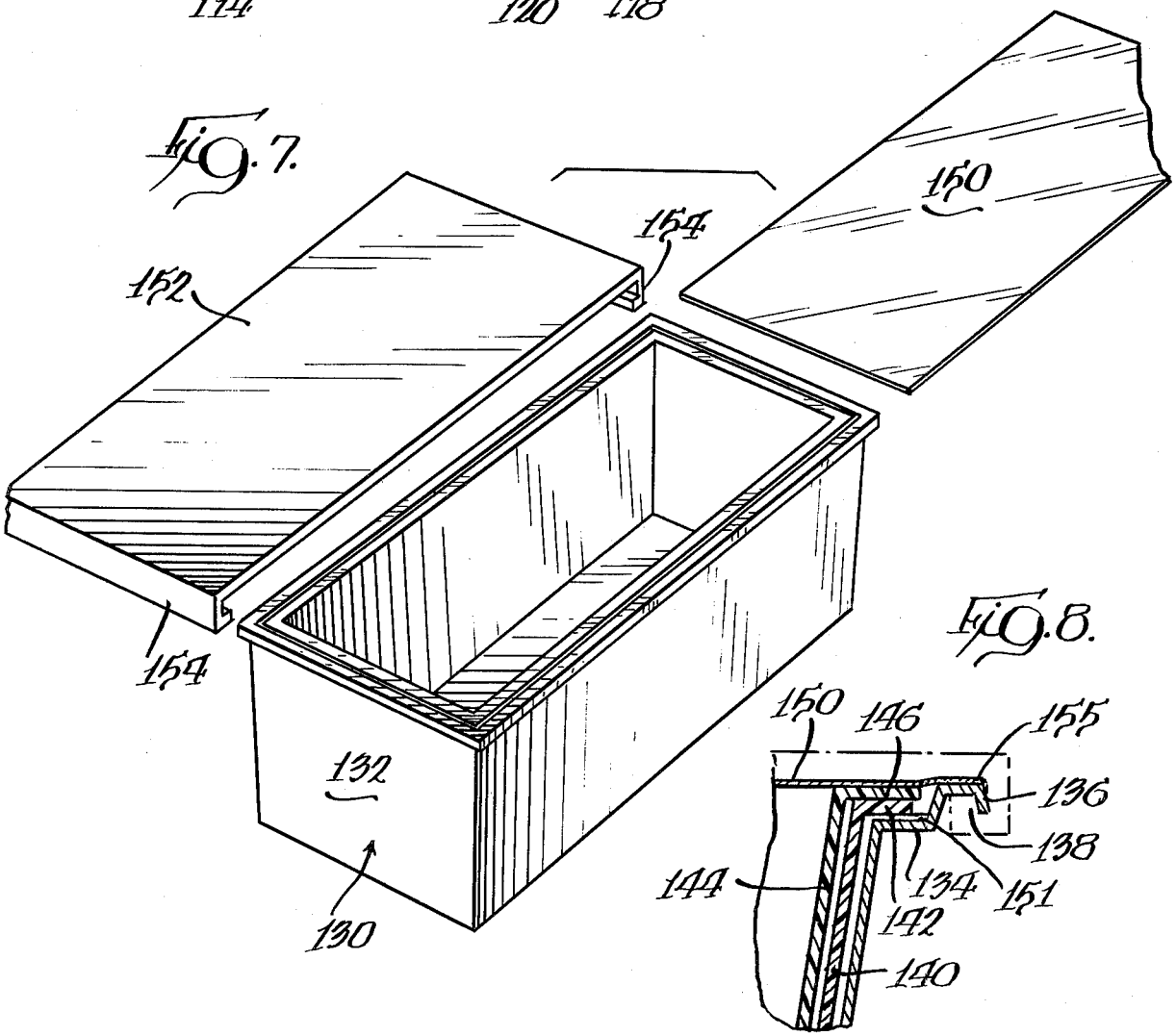
Fig. 8.

COMPOSITE CONTAINER CONSTRUCTION

This application is a continuation of application Ser. No. 144,545, filed 4-28-80, now abandoned.

DESCRIPTION

1. Technical Field

The present invention relates generally to composite container constructions and more particularly, to a composite container that is specifically designed to be hermatically sealed for containing vacuum packaged products.

2. Background Prior Art

Proposals for composite containers have been in existance for a number of years. Generally, the composite container consists of an outer container that has some type of strength characteristics and an inner liner which is normally of a flexible plastic material that can be hermatically sealed. An example of an earlier verison of a composite container is shown in U.S. Pat. No. 2,338,604.

Other examples of composite container constructions are disclosed in the following U.S. Pat. Nos.: 2,082,995; 3,285,461; 3,383,026; 3,620,399; 3,790,021; 4,141,466; and 4,169,540.

For many years, attempts have been made to substitute some type of package for the conventional metal container that is utilized for packaging of food products, such as vegetables and coffee. In the packaging or canning of vegetable products, it has been customary to provide a rigid metal container that is corrugated around the cylindrical peripheral intermediate portion to provide rigidity for the container and allow it to withstand crush pressures as well as resist collapsing during various phases of packaging and processing of the product therein. Conventionally, in the packaging of sanitary food products, the metal container must be internally lined to prevent any contamination of the product during processing and storage prior to ultimate use.

In the processing of food products, such as vegetables, it is standard practice to place raw vegetables into the open end of the container, supply a negative pressure to the product to remove all oxygen from the inside of a container and seal an end to the open ended container while the vacuum is being applied to the internal area of the container. After the container has been sealed, the container with the product therein is normally passed through some type of heating process wherein the product is heated for a short period of time in the range of at least 250° F. During such heating, the product of course expands and the container has internal pressures applied thereto. However, upon cooling, after the finishing of the process, the food product again contracts and therefore the inside of the container again is at a negative pressure which the container must withstand without collapsing.

In packaging other products, such as coffee, the product is placed in a container, a vacuum is applied thereto and the container is sealed resulting in a vacuum inside the container which the container withstands without collapsing. Some other products are hot filled, sealed and then cooled which also results in a negative pressure in the container.

In the transportation of various articles, many times the articles are stacked in numerous cases upon each other which means that the lower container must be capable of resisting substantial crush pressure from the remaining containers supported thereon. It is also possible for the containers to be dropped and again the container must withstand the forces encountered without collapsing.

Numerous attempts have been made to substitute various types of less expensive and less rigid packages particularly for food products and an example that has been dealt with for a number of years is what is commonly referred to as a "retort" pouch. In order to meet the various governmental requirements, the typical pouch construction consists of a layer of polypropylene attached through an adhesive to an aluminum foil layer with a further polyester layer adhesively secured to the opposite surface of the foil. The aluminum foil provides the oxygen barrier resistance that is required for packaging such products while the polypropylene is utilized to provide chemical inertness for the product and the polyester layer produces the necessary mechanical strength for the pouch.

One of the main problems with a pouch of this type, when used for packaging food products, is the fact that the relatively flexible package slows the filling speeds of the filling line and therefore, increases the cost thereof. For example, pouches of this type require a special system that will provide a mechanical support for the pouch during the heating or processing operation for the contents.

A further problem that has been encountered with the pouch type package is the fact that the pouch does not have sufficient rigidity to be self-supporting without collapsing during shipment and display. Thus, most pouches that are utilized for packaging, particularly food products, are, of necessity, placed in an outer cardboard or other carton for shipment and display purposes, adding to the overall cost of the package.

SUMMARY OF THE INVENTION

According to the present invention, a container has been developed which has less structural requirements than a conventional metal can without sacrificing filling speeds such as occur when using flexible containers.

The container of the present invention comprises a composite container construction including an outer container that has a bottom wall and rigid side wall with an open top and an inner non-metallic container or liner having a closed bottom wall and a side wall which corresponds substantially in configuration to the outer container and has an open top for receiving a product. The inner and outer containers are attached to each other along the upper open peripheral end and are separated throughout the remaining area. The outer container provides structural rigidity to meet stacking and abuse resistance requirements.

The space between the two containers is initially vented to the atmosphere through an opening in the outer container so that the inner container can expand and contract in response to positive and negative pressures applied to the inner surface of the container from a product during filling and processing of the product.

The composite container also includes a cover for sealing the open end of the inner container or liner after insertion of the product.

With the container construction described above, the inner container is adapted to receive the product during a normal filling process and normally has a negative pressure or vacuum applied thereto after the product has been inserted therein to remove all of the "head space" oxygen before the container is sealed. Also, the product is many times processed after it has been inserted into the container and a vacuum seal has been applied. The container construction of the present invention allows the inner liner to expand and contract during heating and cooling of the product while the outer container remains substantially at atmospheric pressure both on the inside surface and the outside surface thereof to reduce the forces that must be encountered by the outer container and the outer container is later sealed.

In one embodiment of the present invention, the inner and outer containers are both formed in a thermoforming operation and the inner container has a rigid peripheral ring surrounding the open end thereof while the outer container has a peripheral rim along the upper open end thereof. The rim and ring are constructed such that the ring can be snapped onto the outer container and releasably retained thereon. In addition, the cover preferably includes a heat sealable plastic film that is heat sealed to a surface of the ring prior to insertion of an overcap over the ring which is releasably retained thereon and can be utilized as a cover after the film has been removed for gaining access to the contents. In this embodiment of the invention, the periphery of the film is heat sealed to a flat surface that is defined in a recess extending from the upper surface of the ring so that the surface is displaced below the major upper surface of the ring. In this embodiment, the overcap portion of the cover is specifically configured so that the periphery of the film is clamped between the cover and the surface on the ring to assist in preventing the destruction of the seal during processing of the product.

In another form of the invention, the ring has peripheral threads formed integral with the outer surface of the ring and the overcap has cooperating threads so that the overcap can be threadedly secured and easily removed. In this embodiment of the invention, the plastic film may be used if desired. However, in some processes it may not be necessary to provide a separate sealing film in addition to the overcap.

In a further modified form of the invention, the ring has a sealing surface that is located on the periphery thereof and extends axially of the inner container with the cover film heat sealed to this surface to aid in resisting forces that may be encountered during packaging and processing of the product. The cover engages and grips the sealed area of the film to assist in resisting shear forces that are encountered by the seal while locating the seal in such a manner that it cannot be contaminated by the filling operation which could result in an ineffective seal.

In a further modified form of the invention, the outer container is a conventional three piece metal container that has an end doubled seamed to one end thereof. The opposite open end is adapted to receive the inner container or liner which can be temporarily secured to an outwardly directed flange thereon for temporarily holding the liner during the filling process. After the product has been inserted into the inner liner, the upper edge of the liner and the periphery of an end or closure are doubled seamed to the upper end of the outer container so that the inner liner remains completely unattached from the outer container except around the upper peripheral edge thereof. The space between the inner and outer containers is again vented so that the inner liner can expand and contract to response to variation in pressure within the inner container while the outer container defines a rigid structure which provides a second impermeable barrier upon the later sealing of the vent.

Utilizing the concept of the present invention as a substitute for the conventional corrugated metal can, particularly the three piece metal can, has many advantages. For example, the composite container allows for reduction in the structural requirements for the outer container and the end and wall thickness can be reduced by as much as 50% while the lead contamination problem is eliminated because the product does not come in contact with the lead seam.

In a further modified form of the invention, the composite container includes a further or third intermediate liner between the inner and outer container components and the various liners may be formed from different materials having different characteristics. In this embodiment of the invention, the cover can either be snap fitted onto the upper end of the container or alternatively may be hingedly secured along one edge. Preferably, the inner container is filled prior to attaching the cover by a heat sealable plastic film, which could also be connected through a hot melt or other types of adhesives, depending upon the chemical composition of the film as well as the surface to which it must be sealed.

BRIEF DESCRIPTION OF SEVERAL VIEWS OF DRAWINGS

FIG. 6 is a cross-sectional view of a further modified form of container construction;

FIG. 7 is an exploded perspective view of a still further modified form of the invention;

FIG. 8 is a fragmentary cross-sectional view of the container illustrated in FIG. 7 and shown in the closed and hermatically sealed condition.

DETAILED DESCRIPTION

Figure 1:
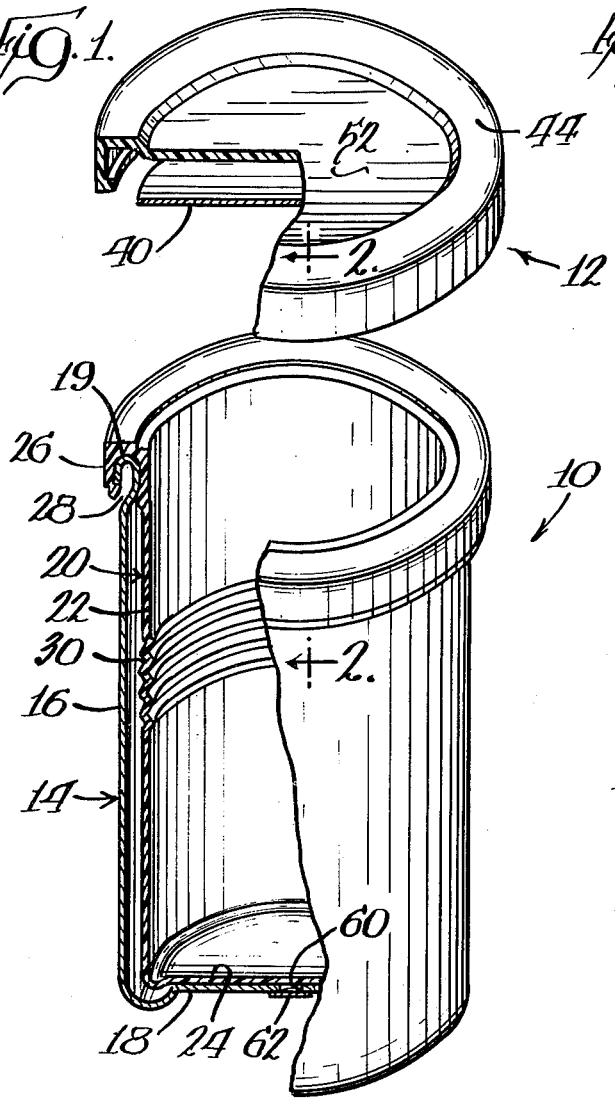
FIG. 1 is an exploded perspective view, partially in section, showing a container constructed in accordance with the present invention.

While this invention is susceptible of embodiment in many different forms, there is shown in the drawing and will herein be described in detail preferred embodiments of the invention with the understanding that the present disclosure is to be considered as an exemplification of the principles of the invention and is not intended to limit the invention to the embodiments illustrated.

FIG. 1 of the drawings discloses a container, generally designated by reference numeral 10, having a cover generally designated by reference numeral 12. Container 10 consists of an outer shell 14 which may be of a variety of materials and has been illustrated as being a thermoformed plastic container that has an integral side wall 16 and a unitary end wall 18 on one end thereof with an opposite open end. The outer container 14 is preferably formed from a material that is oxygen impermeable and has a rim 19 formed around the open end by reverse bending the upper edge of side wall 16. The outer container may also be light impermeable.

An inner container 20 consists of substantially cylindrical side wall 22 having an integral end wall 24 both of which conform generally to the configuration of the outer container 14. The inner container has a rigid ring 26 at the upper open end thereof and the ring defines a substantially U-shaped downwardly directed channel 28. The side wall of the inner container 20 also has a corrugated portion 30 and is attached to the outer container by having the ring 26 snapped over the peripheral rim 19 around the upper opened end of the container shell 14. Thus, the entire inner container is free from the outer container 14 except along the upper peripheral edge thereof and conforms to the outer container while the corrugated portion allows the inner container to collapse due internaal negative pressure resulting under certain conditions, as will be explained later. A collapse or flexing inward is desired since under Boyles law as the volume is decreased the pressure will increase and the differential pressure to which the inner container is subjected to will be less. This allows the use of thinner walled inner containers.

Figure 2:
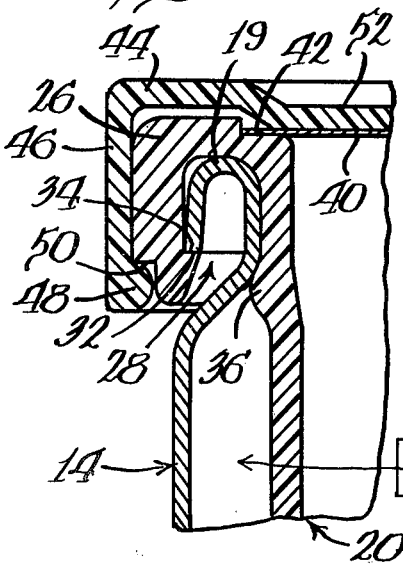
FIG. 2 is an enlarged fragmentary sectional view, as viewed along line 2—2 of FIG. 1, showing container in its final sealed condition.

As illustrated in FIG. 2, the inner or the upper peripheral rim 19 of outer container 14 is substantially U-shaped in cross-section and defines a downwardly directed lip or ledge 32 around the upper perimeter of outer container 14. Likewise, the substantially U-shaped ring 26 has an inwardly directed lip or ledge 34 that engages ledge 32 to securely hold the inner container shell 20 onto the outer container shell 14. If desired, the molded inner container shell 20 may also have an outwardly directed rib 36 that engages the lower inner surface of rim 19 to securely lock the inner container 20 with respect to the outer container 14.

The inner container or shell 20 is also preferably formed from a thermo plastic material which may be thermoformed on a mass production basis. It is preferred that a solid state pressure thermoforming process be used so fabrication can take place just prior to the material reaching the plastic state so that biaxially oriented product is produced. A process of this type is disclosed in U.S. Pat. No. 4,172,875.

The cover 12 consists of an inner liner 40 which preferably has its peripheral edge heat sealed to an upper surface of plastic ring 26. As illustrated in FIG. 2, the upper inner peripheral surface of ring 26 has a recessed portion to define a substantially flat peripheral ledge 42 surrounding the upper open end of inner container shell 20. The liner or heat sealable plastic film 40 is preferably heat sealed to ledge 42 to hermatically seal the inner container 20 from the atmoshphere. The cover also includes an overcap or member 44 which is again attached to the upper peripheral open end of container 10. For this purpose, the overcap or cover 44 has a downwardly directed flange 46 around the periphery thereof, the lower end of which has an inwardly directed rib 48. Rib 48 is adapted to be snapped over the outer pheriphery of ring 26 and engage a lower edge 50 on the lower periphery thereof to releasably retain the overcap on the container. The overcap protects the film from damage and permits stacking without subjecting the film to stacking forces.

According to one aspect of the present invention, the overcap 44 is designed to assist in maintaining the hermatic seal between the plastic film 40 and the inner container 20. As illustrated in FIG. 2, the central portion 52 of the overcap 44 is displaced downwardly from the upper peripheral surface of overcap 44 by a dimension that is substantially equal to the depth of the recess defining ledge 42, less the thickness of film 40. The periphery of recessed circular flat portion 52 overlaps with ledge 42 so that, when the overcap is in the position illustrated in FIG. 2, the peripheral edge of recessed or dished portion 52 engages the periphery of film 40 and clamps the film between the ledge 42 and the inner surface of center portion 52. This feature substantially increases the forces that can be encountered by the heat seal between the film 40 and the adjacent surface of ledge 42 since the film is essentially gripped between the overcap 44 and the ring 26. By locating the heat seal in the area clamped between the overcap and the ring, the seal is maintained in a shear mode and thus the requirements for the seal are reduced and the bond can maintain substantial pressures, particularly negative pressures. However, when it is desired to remove the heat sealed film, it is only necessary to remove the overcap 44 and grip a tab T forming part of the film 40 to remove the film. The seal between the film and the ring can thus be high in shear strength and weak in peel strength to permit easy removal of the entire film from the container to gain access to the contents.

The container described above normally is initially assembled by having the inner container 20 positioned within the outer container 14 and attached by the rim. The product is then inserted into the inner container and the film 40 is heat sealed to ledge 42 while a vacuum is being applied to the interior of the container to provide a vacuum packing of the material.

In other instances, a hot product is inserted into the container and sealed and a negative pressure is created as the product cools. In heat treatment of the product, a cold product may be inserted and the container vacuum sealed. The sealed container and product are then heated which causes the product and the inner container to expand and then contract when the product is cooled.

As indicated above, one of the problems encountered with containers of this type is to have the ability of the container to withstand positive and negative pressures during the processing of the product within the container.

According to the present primary aspect of the present invention, the composite container constructed in accordance with the present invention has vent means between the inner and outer containers to vent the space between the two containers during filling and processing of the container. As illustrated in FIG. 1, the bottom wall 18 of outer container 14 has a vent opening 60 therein which provides communication from the space between the two container shells to the atmosphere. Thus, during the application of negative pressures within the inner container, the container can collapse, with the collapsing being controlled or restricted to the corrugated area 30 of the inner container. During this contraction of the inner container, while vacuum is being applied therein, the space between the inner and outer container is maintained at an atmospheric pressure so that the outer container need not be subjected to the negative pressures that are being subjected to the inner container. This particular feature is of significant advantage in reducing the structural rigidity requirements for the outer container to prevent collapsing thereof while negative pressures are being applied to the product.

Furthermore, during the filling process, the outer container provides sufficient rigidity so that filling speeds are not impaired as is the case with flexible container or pouches. During the filling at rapid filling speeds, the inner container wholly conforms to and is supported by rigid outer container.

Thus, the container of the present invention can readily have the product inserted therein, vacuum applied to the interior of the inner container to remove all of the oxygen therefrom and then have the inner lid or film 40 heat sealed to the upper edge thereof. With the product within the container, if the product is a raw vegetable, the sealed container can be utilized for processing of the product by applying heat thereto or submersing the product within the container in heated water. During such time, the expansion of the product as it is being heated will be absorbed by the inner container without subjecting the outer container to any significant pressures since the space between the inner and outer container is still maintained at atmospheric pressure through the vent opening 60.

Of course, after the product has been processed and is cooled, the inner container will again be subjected to a negative pressure which will cause the container to collapse in a controlled manner while the space between the two containers is still maintained at atmospheric pressure. When the product has been fully processed and returns to room temperature, the vent opening can be sealed by a suitable sealing element 62 such as a foil tab, a hot melt, or any other suitable seal that is impervious to oxygen so that the outer container will act as an oxygen barrier between the atmosphere and the product. If desired, the seal, such as tab 62 could be utilized for insertion or injection of a controlled or inert gas between the inner and outer structures prior to being sealed off and providing an oxygen barrier. This may be particularly beneficial in strengthening the outer container against abuse resistance while improving column load strength with ultra-thin side wall thickness. Another variation would be to insert an absorbent material between the liner and outer container that could absorb gases that might permeate the liner. In the case of coffee packaging, vacuum packed coffee may generate carbon dioxide gas during storage and display. This carbon dioxide could be absorbed by the absorbent material should it migrate through the inner container.

If the product is a vegetable and the outer container is metal, such as a drawn metal container, the inner container can be removed and placed into a microwave oven, since the inner container contains no metal.

An additional feature is that the cover 44 can be used to reclose the inner container for storage of the product if it is not all consumed when film 40 is removed and film 40 may be translucent to permit viewing of the product.

Figure 3:
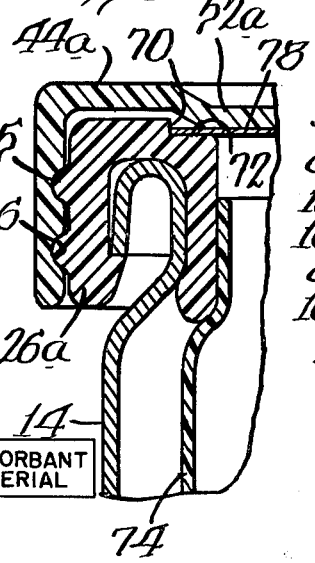
FIG. 3 is a view similar to FIG. 2 showing a slightly modified form of the invention.

A slightly modified form of the invention is illustrated in FIG. 3 which is similar to FIG. 2. In the modified form of the invention, the outer container 14 is substantially identical to the container illustrated in FIGS. 1 and 2 while the inner container is modified as will now be described. In this embodiment of the invention, the inner container consists of a substantially rigid ring **26*a* that is preferably formed from a plastic material that has heat sealing characteristics and again has a recess 70 defining a ledge 72. In this embodiment of the invention, the inner container consists of a flexible bag or pouch 74 that has its upper peripheral edge heat sealed to the inner surface of ring 26*a*. Pouch 74 is preferably formed from a plastic polyolefin film such as polypropylene and two sheets of such film are heat sealed along their edges and bottom so that they can be separated to conform generally to the shape of the outer container. In this embodiment of the invention, the upper ring 26*a* has threads 75 formed on the outer peripheral surface thereof while the overcap 44*a* has cooperating threads 76 formed on the internal peripheral surface thereof. The cover in the embodiment illustrated in FIG. 3 again includes a heat sealable film 78 that is heat sealed to ledge 72 in the same manner as that disclosed in the embodiment of FIGS. 1 and 2. In addition, the overcap 44*a* again has a dish portion 52*a* that has its periphery in engagement with the heat sealing connection between film 78 and ledge 72**.

As in the previous embodiment, the outer container 14 has a vent opening 60 so that the flexible pouch 74 can expand and collapse when positive and negative pressures are applied to the interior of the pouch during the filling and processing of the product therein.

Figure 4:
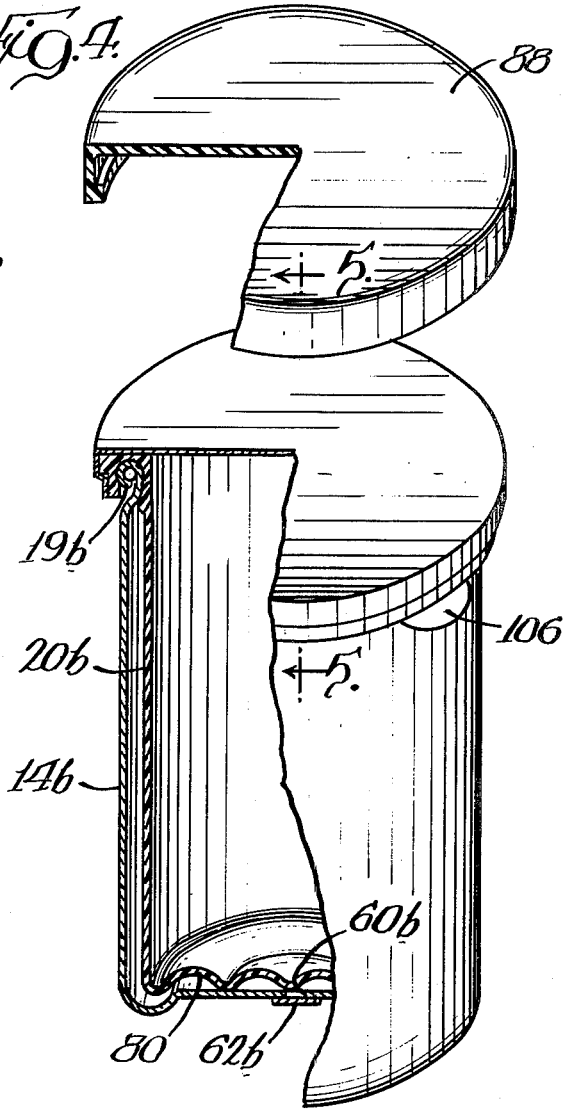
FIG. 4 is a view similar to FIG. 1 showing a further modified form of the invention.

A slightly further modified form of the invention is illustrated in FIGS. 4 and 5 and again consists of an outer container **14*b* that is substantially identical to container 14 with the exception of the upper rim 19*b* which is in the form of a curl, as more clearly illustrated in FIG. 5. In the embodiment illustrated in FIGS. 4 and 5, the inner container 20*b* has a corrugated lower wall 80 which is collapseable and expansible to accommodate negative and positive pressures within the inner container and performs the same function as corrugations 30 in the embodiment illustrated in FIG. 1. In this embodiment, the inner container 20*b* is preferably thermoformed from a heat sealable plastic material while the outer container 14*b* again has a vent opening 60*b* in the lower wall thereof which is closeable by a plug 62*b*** after the contents have been inserted into the inner container and sealed and processed.

Figure 5:
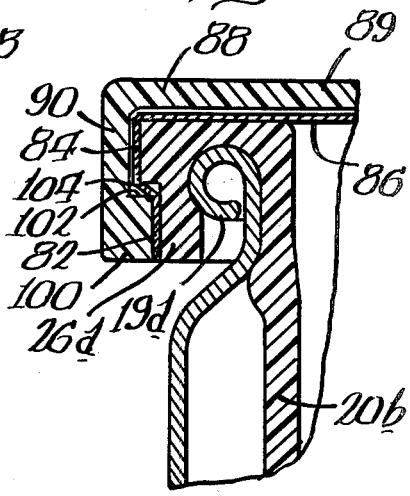
FIG. 5 is a cross-sectional view, as viewed along line 5—5 of FIG. 4.

According to one aspect of this embodiment of this invention, the heat sealing of the cover film to the inner container occurs at a location which will again assist in preventing destruction of the seal when positive or negative pressures are applied within the sealed container. As illustrated in FIG. 5, the ring **26*b* has a peripheral surface 82 which extends substantially parallel to the axis of the circular container and has an enlarged portion 84 located above surface 82. The cover film 86 extends across the upper surface of the rim or ring 26*b*, downwardly over the enlarged portion 84 and in juxtaposed relation to surface 82 where it is heat sealed to the surface. During the heat sealing, the film will conform to provide a tight seal along enlarged portion 84 and a hermatic seal along surface 82**.

In this embodiment of the invention, overcap or cover 88 has an upper flat wall 89 which engages the upper flat surface of film 86 and a peripheral depending flange 90 having an enlarged portion 100 at the lower end thereof. The enlarged lower end portion 100 defines a ledge 102 that cooperates with a corresponding ledge 104 on ring **26*b***.

Thus, in its fully assembled condition as illustrated in FIG. 5, the heat sealed area between film 86 and rim **26*b* which also could be a hot melt or other bonding agent, extends axially of the container outside ring 26*b* and the overcap 88 is in extended engagement with the sealed area between the film 86 and the rim 26*b***. It will also be appreciated that since the sealing area is located outside the filling area on the outer surface of the ring, contamination of the seal from the product during the filling operation is substantially eliminated.

In its sealed condition, the seal will have a high shear strength and a weak peel strength since the peeling of the film will result in forces perpendicular to the sealing surface rather than tangentially thereto. Again, a suitable tab 106 may be attached to the periphery of the film for removal when the contents are to be removed.

It should also be noted that in all of the embodiments so far described, the upper end of the outer container is necked in to reduce the material requirements for the cover and could be necked in sufficiently so the periphery of the reclosable cover would be within the confines of the periphery of the side wall of the outer container to simplify handling and processing of the filled containers.

A further slightly modified form of the invention is illustrated in FIG. 6, wherein a conventional 3-piece metal can 110 is utilized as the outer container and includes a cylindrical body 112 having an end 114 double seamed by a seam 116 to the lower end thereof. The end 114 has the vent opening 118 which is closed by a plug or other member 120, as will be described later. The inner container 122 is preferably a flexible polyolefin plastic such as polypropylene, which is formed as a flexible bag or pouch. In this embodiment of the invention, the upper peripheral edge of the outer container initially has an outwardly directed flange (not shown) extending substantially perpendicular to the axis of the cylindrical body 112 which is subsequently utilized in attaching an upper end 124 by a double seaming 126. Preferably, the inner flexible bag or container 122 is initially bonded to the outwardly directed flange prior to insertion to the product therein and conforms generally to the configuration of the outer container. A product may then be inserted into the inner bag 122, vacuum applied thereto and upper end 124 doubled seamed thereto as illustrated at 126 with the double seam also incorporating the upper peripheral edge of bag 122 to provide a seal between the upper edge of the outer container 110 and the upper edge of the bag 122. Vent opening 118 is unobstructed during the filling and seaming process so that the space between the inner and outer containers is vented to the atmosphere to allow the bag to expand and contract during filling and processing while the outer container is exposed to atmospheric pressure on both the inner and outer surfaces. After the container has been filled and the contents fully processed, the plug 120 is inserted into vent opening to provide a substantially oxygen impervious outer container which need not be of sufficient rigidity to be subjected to the negative forces encountered by the inner flexible bag.

In fact, it has been determined that, when the container 110 is used for vacuum packaging of products, such as coffee and vegetables, the conventional corrugations on present day containers can be eliminated and the wall thickness of cylindrical body 112 can be substantially reduced to reduce the cost of the container. Furthermore, lead contamination, which has become a severe problem recently, is eliminated because the product is not exposed to the surface of the metal container. Thus, the coating requirements for the inner surface can be reduced and in some instances eliminated.

The outer container side wall seam 113 may be produced by several methods such as soldering, welding, or gluing. Its preferential use would be tinless steel for the outer container so as to reduce cost as tin, which is a component of solder, is becoming a scarce element. Such tinless steel is referred to as black plate or tin free steel, which is steel with a chrome oxide coating to provide corrosion resistance comparable to tinplate. As the product does not contact the outer container it is thus possible to use black plate or tin free steel that may have the sidewall adhesively bonded with hermetic materials that could not normally be used for contact with foods but provide excellent adhesion and hermetic sealing qualities. Such a construction also permits fully lithographed containers that improve the display area by not having a void margin as is the case with a soldered or welded container. The problems of iron pickup by corrosive products packaged in three-piece side wall joined is eliminated as is the absorption of lead into the food in the case of a soldered container by providing a barrier between the product and the outer container with the inner liner. It may be further possible to eliminate or gently reduce the sealing gasket material within the ends that creates a hermetic seal at the double seam 116 or 126 in a standard can. Many food cans require protective coatings that may not be required due to the lack of product contact mentioned which would result in reduced process operations including incineration of the solvents to reduce air pollution that are required to apply the protective coatings.

By way of example and not of limitation, a present day conventional three pound coffee can is made from a 107 pound (0.1177 inch wall thickness) tin plate coated steel having corrugations intermediate opposite ends. Utilizing the present invention, a 55 pound (0.0605 inch wall thickness) can be used without corrugations for the outer container without sacrificing buckle and collapsing strength.

With the above arrangement, a hot filled liquid or a vacuum packed product can be packaged using existing equipment without any modification thereof.

A further modified form of the invention is illustrated in FIGS. 7 and 8 and the general concept incorporated into this embodiment could likewise be incorporated into any of the embodiments previously described. In this embodiment of the invention, the outer container 130 has a substantially rectangular side wall 132 and has a flat bottom wall that is integral therewith. Preferably, the outer container 130 is thermoformed from a plastic material that has heat sealing capabilities. The upper peripheral edge of outer container 130 preferably has an outwardly directed flange 134 (FIG. 8) and a lip 136 that defines a locking recess 138, as will be described later.

In this embodiment of the invention, the composite container also includes an intermediate container or shell 140 that conforms generally to the configuration of the outer container or shell 130 and also has an outwardly directed flange 142 at the upper peripheral edge thereof. A third or inner thermoformed plastic container 144 again conforms to container shells 130 and 140 and has an outwardly directed flange 146. A suitable plastic film 150, preferably having heat sealing characteristics is adapted to be heat sealed to the exposed peripheral surface of the flange 146 of the inner container 144. Preferably, an overcap or cover 152 has a pair of flanges 154 at opposite edges thereof which cooperate with recesses 136 to releasably retain the cover 152 on the container after the product has been inserted and the film 150 heat sealed to the open end thereof. The cover could also be attached along one edge by an integral flexible hinge to flange 134.

The advantages of utilizing a thermoformed multilayer composite container as illustrated in FIG. 8 that are saparately formed and then inserted within each other are numerous. For example, the various separate plastic parts could be formed from different materials that would not be compatible with each other when formed as a lmainated structure. By way of example, the outer container shell 130 could be formed from a foamed type plastic material that has little or no permeation resistance while the intermediate liner or container shell 140 could be formed from a highly permeation resistant plastic material that would be an excellent oxygen barrier while the inner container shell 144 could be formed from a polypropylene that is highly stable and will not contaminate the product ultimately inserted therein.

The venting of this type of design can be accomplished in several ways. The first would be to utilize the poor permeation resistance of the outer container and would permit expansion and contraction of the inner liners as the positive and negative pressures are developed in the filling and storage of the containers. If a nonpermeable outer container is used then the predescribed methods of providing a vent hole (not shown) in the outer container and subsequent sealing may be utilized. Still another variation would be to vent through an air passageway channel 151 located between outer container flange 134 and intermediate container flange 146. The air space 153 between outer container 134 and intermediate container 140 is thus vented to the atmosphere through channel 151 and past film 150 before sealing of film 150 to upper peripheral surface 155 on outer container 130. Film 150 may be sealed to the top inner container flange 146 after filling but its peripheral area is not to be sealed to outer container surface 155 until after necessary venting is accomplished.

Actual tests have shown that the containers constructed in accordance with the present invention are capable of withstanding increased buckle pressures, such as for example, when the filled container is dropped because it is believed that the liner expands inside the container and the product produces a positive pressure on the side wall of the outer container to strengthen the side wall.

Further testing with 2 milligram polypropylene bags assembled into containers have demonstrated functionality of the invention. Containers as illustrated in FIG. 6 were produced and packed with green beans prior to retorting for 20 minutes at 250° F. in a pressurized retort. After cooling, the samples were examined. Control cans had nine inches of vacuum as did variables with no vent holes. Samples with vent holes had significantly reduced vacuum and all cans were examined for leakage or rupture of the liner with none detected illustrating support of the liner by the outer container in the positive pressure mode and the ability of the liner to contract in the negative pressure mode. Additional tests were made with thin wall nonvacuum design cans that had inserted into them thermoformed polypropylene liners with wall thicknesses ranging from 1 to 6 milligrams prior to hot filling at 190° F. with a noncarbonated juice drink. Samples with no liners failed due to the negative pressure in what is termed paneling or distortion of the outer container side wall. None of these with liners failed. It was further determined that in abuse testing that if the liner was not capable of equalling or exceeding the space within the outer container in drop testing that the hydraulic forces may cause rupture of thin wall liners. Forty-six ounce juice cans were dropped from heights up to 24 feet with leakage being induced in control, or those without liners, while after providing the slightly oversized liner leakage was greatly reduced.

The unique composite container construction reduces the structural and geometric requirements so that materials such as paper, foil, plastics, steel, aluminum, or glass can be used for the outer container.

It should be pointed out that all embodiments, the term film is intended to encompass a single sheet or a composite structure such as a laminated sheet.

I claim:

1. A method of packaging products comprising the steps of placing an inner flexible liner means into an outer container, said outer container having a relatively rigid side wall means upstanding from the bottom wall to provide an open end, forming a rigid ring on an upper peripheral open end of said liner, attaching the rigid ring to the periphery of said open end of said container to produce a seal between the liner and container and a space between the liner and container below the open ends, introducing a product into said liner through an open end thereof with said liner flexing during insertion of said product to generally conform said liner to the inside of said outer container, sealing said open end of said liner, causing said product in said liner to contract whereby at least portions of said liner will draw away from said outer container, the contraction of said product causing a substance to be drawn through said vent hole means into said space between said liner and said outer container, and subsequently sealing said vent hole means to seal the space between said liner and said outer container.

2. A method as defined in claim 1, in which said product is inserted in a heated state and said liner is hermetically sealed so that cooling of said product will produce said contraction and consequent negative pressure.

3. A method as defined in claim 1, in which said contraction is effected by applying a vacuum source to the interior of said liner prior to the hermetic sealing of said liner.

4. A method as defined in claim 1, wherein said substance drawn into said space in inert.

5. A method as defined in claim 1, including the further step of inserting an absorbant material into said space.

6. A method as defined in claim 1, including the further step of creating a positive pressure in the space between said liner and said outer container.

7. A method as defined in claim 1, including the further step of inserting an intermediate shell between said outer container and said liner and venting the space between said intermediate shell and outer container adjacent said open end and in which said open end is sealed with a film and said film is subsequently sealed to said outer container to close said vent hole means.

8. A method of vacuum packaging food products comprising the steps of inserting an inner liner into an outer container having a rigid side wall and a bottom wall, supporting a peripheral open end of said liner on the peripheral open end of said container, producing an air space between said outer container and said liner that is in venting communication with the atmosphere through a venting opening with the vent opening being located between the open end of the liner and the open end of the container, inserting a product into said liner, hermetically sealing said open end of said liner with a cover liner and effecting a negative pressure in said liner while maintaining the air space between said container and liner at substantially atmospheric pressure, and subsequently sealing a vent opening with said cover liner after said product is sealed and processed to hermetically seal said outer container.

9. A method of vaccum packaging food products comprising the steps of providing an intermediate shell in a container having a rigid side wall and a bottom wall, inserting a flexible liner into said intermediate shell, supporting a peripheral open end of said intermediate shell and flexible liner on a peripheral open end of said outer container, producing an air space between said intermediate shell and outer container that is in venting communication with the atmosphere through a passageway, inserting a product into said liner with said liner and intermediate shell flexing during insertion to conform generally to the inside of said intermediate shell, sealing said open end of said liner, intermediate shell and container with a film, and sealing said passageway with said film.

* * * * *